US006829977B2

(12) United States Patent
Messmer

(10) Patent No.: US 6,829,977 B2
(45) Date of Patent: Dec. 14, 2004

(54) COMBUSTION ENGINE WITH A BUILT-UP PISTON

(75) Inventor: Dieter Messmer, Remseck (DE)

(73) Assignee: Mahle GmbH, Stuttgart (DE)

( * ) Notice: Subject to any disclaimer, the term of this patent is extended or adjusted under 35 U.S.C. 154(b) by 58 days.

(21) Appl. No.: 10/275,361

(22) PCT Filed: Apr. 7, 2001

(86) PCT No.: PCT/DE01/01404

§ 371 (c)(1),
(2), (4) Date: Feb. 25, 2003

(87) PCT Pub. No.: WO01/86133

PCT Pub. Date: Nov. 15, 2001

(65) Prior Publication Data

US 2003/0154855 A1 Aug. 21, 2003

(30) Foreign Application Priority Data

May 5, 2000 (DE) ..... 100 22 035

(51) Int. Cl.[7] ..... F01B 31/10
(52) U.S. Cl. ..... 92/1
(58) Field of Search ..... 92/157, 186, 220

(56) References Cited

U.S. PATENT DOCUMENTS 1,212,517 A 1/1917 Lemp et al.
2,442,408 A 6/1948 Graham
3,465,651 A 9/1969 Tromel

FOREIGN PATENT DOCUMENTS

| | | |
|---|---|---|
| DE | 5 47 233 | 4/1932 |
| DE | 6 01 815 | 8/1934 |
| DE | 12 53 514 | 11/1967 |
| DE | 23 51 166 | 4/1974 |
| DE | 78 00 918 | 11/1982 |
| DE | 33 46 965 | 7/1985 |
| DE | 35 18 721 | 11/1986 |
| DE | 40 18 252 | 12/1991 |
| DE | 41 31 275 | 3/1993 |
| FR | 1 429 327 | 9/1966 |
| FR | 1 524 454 | 9/1968 |
| GB | 498455 | * 1/1939 |
| GB | 586 036 | 3/1947 |
| JP | 61286555 | 12/1986 |
| WO | WO/00 53913 | 9/2000 |

* cited by examiner

*Primary Examiner*—F. Daniel Lopez
(74) *Attorney, Agent, or Firm*—Collard & Roe, P.C.

(57) ABSTRACT

The invention relates to a built-up piston, comprising central screwing and a central cooling chamber. The aim of the invention is to reduce the flow resistance in the oil delivery area. To this end, means for transferring oil from the piston rod to the central cooling chamber are provided in the area of the screw head of the central screw connection.

3 Claims, 2 Drawing Sheets

COMBUSTION ENGINE WITH A BUILT-UP PISTON

CROSS REFERENCE TO RELATED APPLICATIONS

Applicant claims priority under 35 U.S.C. §119 of German Application No. 100 22 035.5 filed May 5, 2000. Applicant also claims priority under 35 U.S.C. §365 of PCT/DE01/01404 filed Apr. 7, 2001. The international application under PCT article 21 (2) was not published in English.

The invention relates to an internal combustion engine with a constructed piston, consisting of a piston head made of steel and a lower piston part that are connected with one another by way of a single screw arranged in the center axis or close to the center axis of the piston, and with a central cooling space between the piston head and the lower piston part, furthermore with an oil-carrying connecting rod that is connected with the lower piston part by means of a piston bolt.

A piston for an internal combustion engine of this type is known from DE 4131275. In the case of this piston, the cooling oil is introduced, by way of the piston bolt, into the hubs and from there into bores that run vertically, towards the top, into an outer cooling channel, it flows radially towards the inside into a central cooling space, and into the inner form of the piston by way of a run-off.

Because the oil is deflected in the piston bolt and through the long bores, there is a relatively high flow resistance. The invention is therefore concerned with the problem of optimizing the flow of the cooling oil through the piston, and of simplifying the bolt by means of an oil guide that is not integrated into it, i.e. optimizing it in terms of strength.

This problem is solved by means of the characterizing feature of claim 1. Advantageous further developments are the object of the dependent claims. Sliding blocks for conducting oil into a central cooling space are actually known, for example from DE 3518721, FIG. 3. However, a combination of a central screw connection and a sliding block has not been proposed until now, although both characteristics in and of themselves have been known for a long time, since both characteristics are generally arranged at the same location, i.e. in the center axis of the piston in the region of the inner form, and for reasons of space, it hardly appeared possible to implement both characteristics at the same time.

An integration of the two characteristics is taught by the solutions shown.

Figure 1:
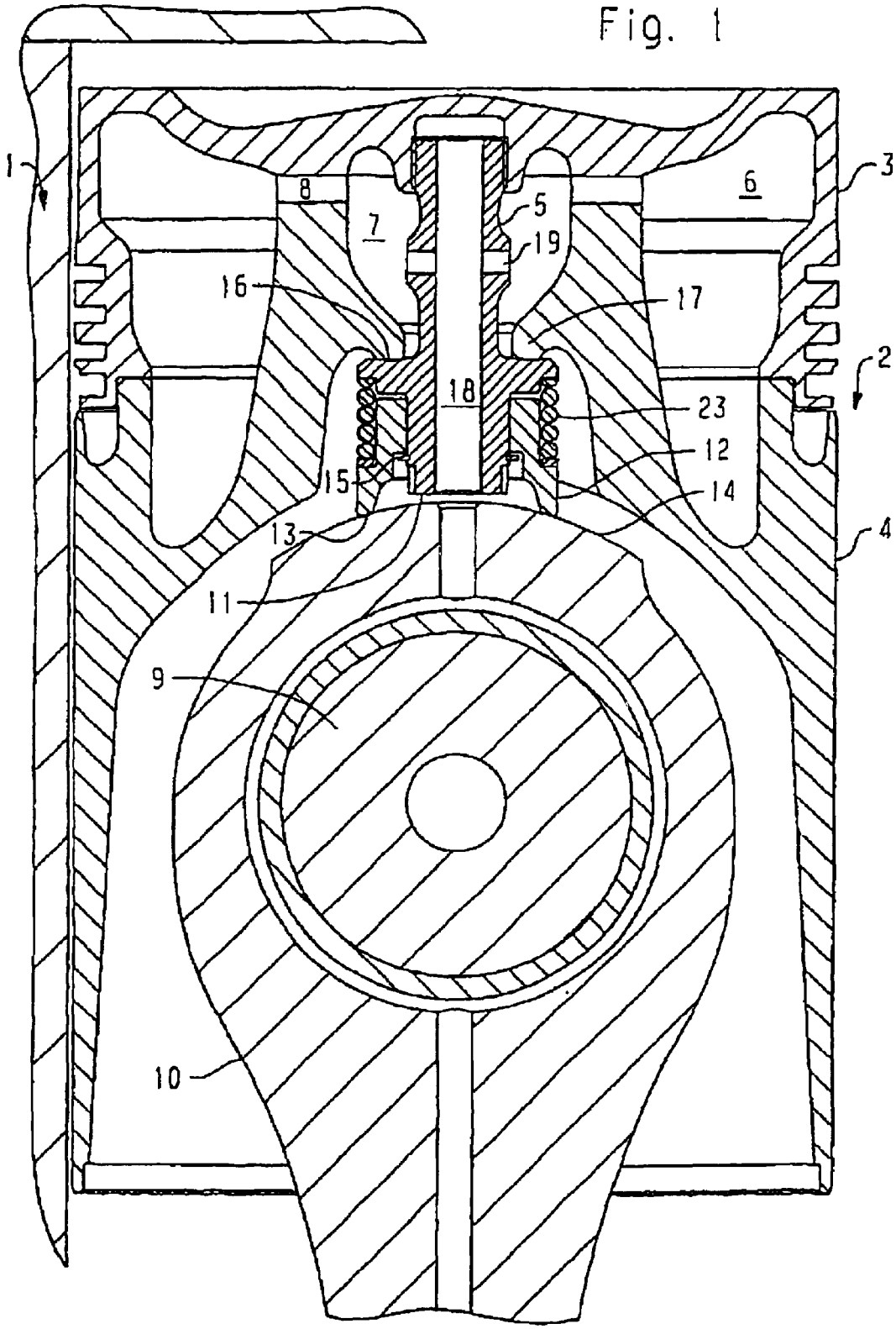
Figure 2:
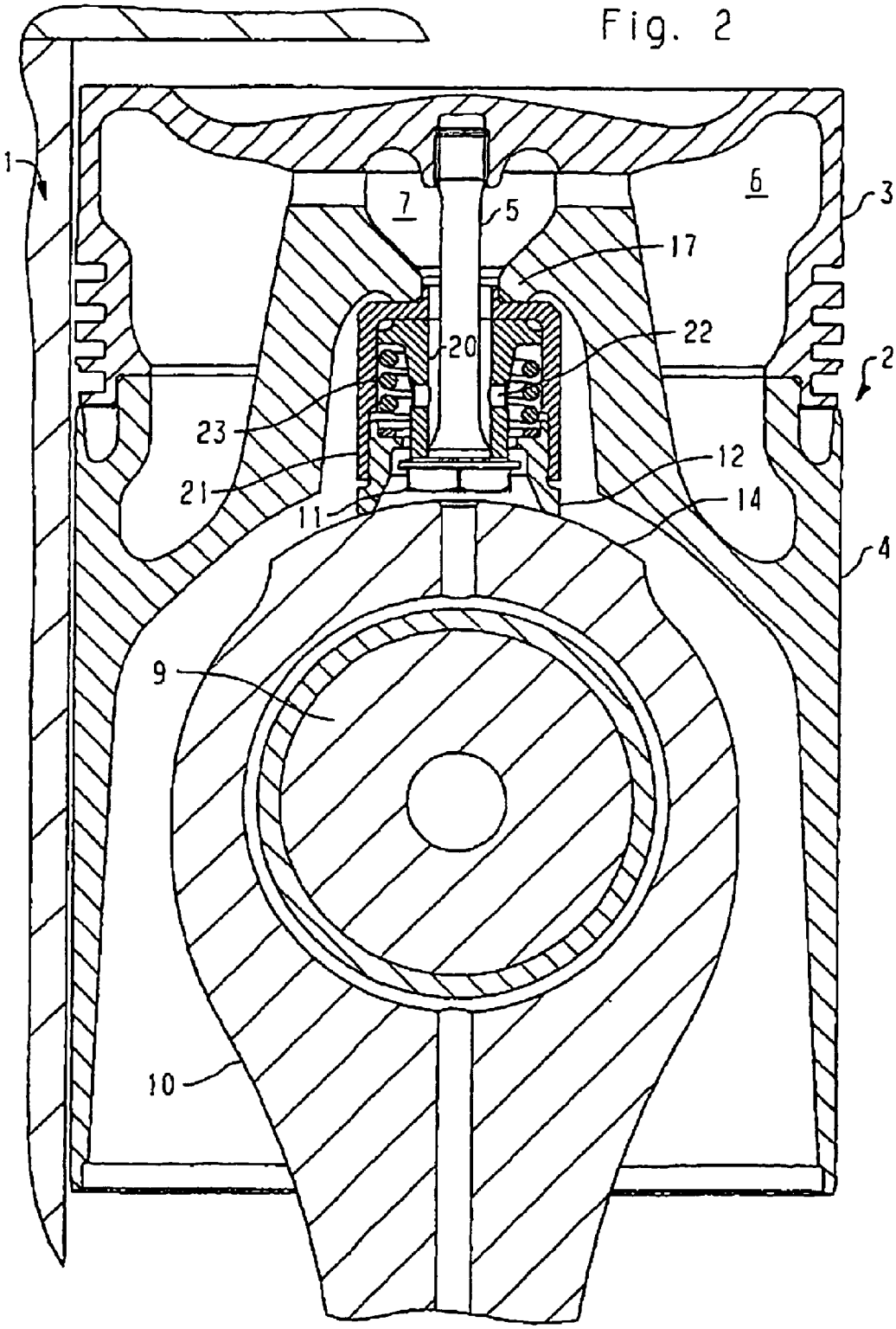

The invention will be explained in greater detail below, using a drawing. This shows:

FIG. 1 a first exemplary embodiment in cross-section,

FIG. 2 a second exemplary embodiment in cross-section.

A constructed piston 2 is arranged, in movable manner, in an internal combustion engine 1—indicated by a cylinder wall of an engine housing. The constructed piston 2 consists of a piston head 3 and a lower piston part 4, which are connected with one another by way of a screw 5 arranged in the longitudinal axis of the piston. Between the piston head 3 and the lower piston part 4 there are a cooling channel 6 and a central cooling space 7, which are delimited by the piston head and the lower piston part, in each instance, and are connected with one another by way of overflow channels 8. The piston 2 is connected with a cooling-oil-carrying connecting rod 10 by way of a piston bolt 9.

In the region of the screw head 11, a sliding block 12 is arranged on the screw head, under spring pre-stress, in a manner so that it can be moved by sliding it. The sliding block 12 has a fitting surface 13 that interacts with a machined surface 14 on the connecting rod 10, thereby preventing cooling oil losses between the connecting rod 10 and the sliding block 12, to a great extent. A locking ring 15 in the screw head 11 serves as a transport lock to prevent loss of the sliding block 12. The screw head 11 rests against a collar 17 in the lower part, with a contact surface 16. The screw 5 has a bore 18 along the longitudinal axis, and overflow bores 19 to the central cooling space 7, which run radially. The spring 23 rests against a shoulder molded onto the screw head, and presses the sliding piece 12 against the connecting rod 10. FIG. 2 shows deviations from FIG. 1 with regard to guidance of the cooling oil and introduction of the screw connection forces into the collar 17. The screw connection forces are introduced into the collar 17 by way of a spacer 20 and a guide piece 21. The cooling oil flows from the sliding block 12, by means of radial bores 22, into the space between the spacer 12 and the screw 5, and from there to the top into the central cooling space 7. The sliding block 12 is mounted in the guide part 21 so it can be moved counter to the force of a spring 23. The spring 23 rests against a shoulder arranged on the spacer. The guide part 21 is fixed in place between the spacer 20 and the collar 17 when the screw 5 is tightened.

What is claimed is:

1. An internal combustion engine comprising:

a) a constructed piston having a longitudinal axis, said piston comprising a piston head made of steel, a lower piston part, and a single screw connecting said piston head to said lower piston part, said screw having a screw head and being arranged along or close to said longitudinal axis;

b) a central cooling space between said piston head and said lower piston part;

c) an oil-carrying connecting rod connected by a piston bolt to said lower piston part; and d) a sliding block provided near said screw head for delivering cooling oil from said connecting rod into said central cooling space, said screw head being disposed at least partially radially within said sliding block;

wherein the cooling oil is guided from said sliding block into said central cooling space via a spacer with radial intake bores, said screw having a portion surrounded by oil arranged within said spacer.

2. The internal combustion engine according to claim 1 wherein said connecting rod comprises a machined surface and said sliding block is pressed by a spring against said machined surface.

3. The internal combustion engine according to claim 1 further comprising a cooling-oil-carrying bore disposed along a longitudinal axis of said screw.

* * * * *